US006766228B2

(12) United States Patent
Chirescu

(10) Patent No.: US 6,766,228 B2
(45) Date of Patent: Jul. 20, 2004

(54) SYSTEM FOR MANAGING THE ROUTE OF A RAIL VEHICLE

(75) Inventor: Mihai Chirescu, Montreuil (FR)

(73) Assignee: Alstom, Paris (FR)

( * ) Notice: Subject to any disclaimer, the term of this patent is extended or adjusted under 35 U.S.C. 154(b) by 54 days.

(21) Appl. No.: 10/081,188

(22) Filed: Feb. 25, 2002

(65) Prior Publication Data

US 2002/0128757 A1 Sep. 12, 2002

(30) Foreign Application Priority Data

Mar. 9, 2001 (FR) ..... 01 03263

(51) Int. Cl.[7] ..... G06F 7/00; G06F 3/00
(52) U.S. Cl. ..... 701/19; 701/20
(58) Field of Search ..... 701/19, 20; 246/347, 246/131, 167 R, 176, 177

(56) References Cited

U.S. PATENT DOCUMENTS 5,508,930 A 4/1996 Smith, Jr.
5,947,423 A * 9/1999 Clifton et al. ..... 246/62
6,118,389 A 9/2000 Kamada et al.
2001/0014847 A1 * 8/2001 Keenan ..... 701/117

FOREIGN PATENT DOCUMENTS

| | | |
|---|---|---|
| EP | 0 547 548 A | 6/1993 |
| EP | 0 583 773 A | 2/1994 |
| FR | 2 765 374 A | 12/1998 |

* cited by examiner

*Primary Examiner*—Yonel Beaulieu
(74) *Attorney, Agent, or Firm*—Sughrue Mion, PLLC

(57) ABSTRACT

This management system for managing the route of a rail vehicle travelling on a rail network between a departure point and an arrival point includes a central processor unit configured to cause a change in the route of the rail vehicle between a route-change node and a convergence node at which the changed route converges back on the initial route. The central processor unit is further configured to determine a set of routes comprising all of the possible routes between the route-change node and the convergence node, and compare the set of routes with the initial route so as to cause the route change to be made along the route that is closest to the initially-planned route.

7 Claims, 2 Drawing Sheets

SYSTEM FOR MANAGING THE ROUTE OF A RAIL VEHICLE

The present invention relates to a system for managing the route of a rail vehicle travelling on a rail network between a departure point and an arrival point.

BACKGROUND OF THE INVENTION

As is conventional, rail networks are generally provided with detection means for detecting the position of the vehicle on the network, which means are connected to a central processor unit in which an algorithm is loaded that makes it possible to instruct a change in the route followed by the rail vehicle between the departure point and the arrival point, and, in particular, between a route-change node and a convergence node at which the route converges back on the initial route.

By means of a suitable machine interface, the central processor unit enables an operator to enter, in succession, the list of the points of the network via which the vehicle must travel as a function of external events that can require a change to be made to the initially-planned route.

For example, a change in the route can be made necessary by the fact that a departure platform or an arrival platform is unavailable, or by the presence of an obstacle on the rail track.

To change the route, the operator keys in manually all of the way points between the route-change node and the initial route convergence node, and then, where necessary, provides the link-up with the next stops.

Although that technique is relatively effective and reliable, it suffers from drawbacks, in particular because the operation is lengthy and must currently be performed manually.

OBJECTS AND SUMMARY OF THE INVENTION

An object of the invention is to mitigate that drawback.

The invention thus provides a management system for managing the route of a rail vehicle travelling on a rail network between a departure point and an arrival point, the network including detection means for detecting the position of the vehicle on the network, and a central processor unit provided with means for causing a change in the route of the rail vehicle between a route-change node and a convergence node at which the changed route converges back on the initial route, wherein the means for causing a route change include means for determining a set of routes comprising all of the possible routes between the route-change node and the convergence node, and means for comparing said set of routes with the initial route so as to cause the route change to be made along the route that is closest to the initially-planned route.

The management system of the invention may have one or more of the following characteristics, taken in isolation or in all of their technically-feasible combinations:

- the central processor unit includes computing means for computing the journey time along the route as changed by the means for causing a route change;
- the computing means comprise means for computing the journey time along each section of changed route;
- the central processor unit includes means for changing the time for which the rail vehicle stays at that arrival point;

- the central processor unit includes means for changing a route or the arrival point of a rail vehicle, while the rail vehicle is travelling along said route;
- when the rail vehicle is constrained to change departure platform, the route-change node is constituted by the departure point of the rail vehicle; and
- when the rail vehicle is constrained to change arrival platform, the convergence node is a virtual point situated downstream from the arrival point, the rail vehicle being stopped at the arrival platform lying on the changed route.

BRIEF DESCRIPTION OF THE DRAWINGS

Other characteristics and advantages appear from the following description given merely by way of example, and with reference to the accompanying drawings, in which.

MORE DETAILED DESCRIPTION

Figure 1:
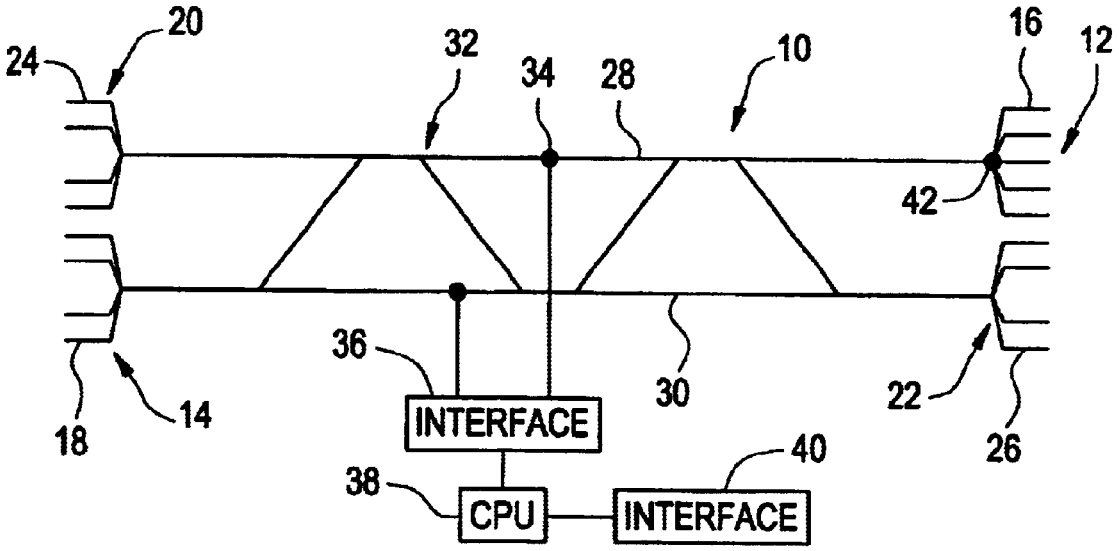
FIG. 1 is a diagrammatic view of a portion of rail network equipped with a management system of the invention.

FIG. 1 is a diagram showing a portion of rail network equipped with a route management system capable of computing, in real time, the route along which a train travels between a departure point and an arrival point.

The portion 10 of rail network shown in FIG. 1 extends between departure points 12, 14, each of which is constituted by a set of departure platforms, such as 16 and 18, and arrival points 20 and 22, each of which is also constituted by arrival platforms, such as 24 and 26.

In the example shown in FIG. 1, the portion 10 of network is made up of two rail tracks 28 and 30. As is conventional, the tracks are subdivided into sections and are provided with switch devices such as 32 for switching the rail vehicle between the tracks 28 and 30.

In addition, the rail network is provided with vehicle detection devices such as 34 that are uniformly distributed in each section, so as to detect, in real time, the position of the rail vehicle on the track along which it is travelling.

All of the equipment of the rail network 10, namely the switch devices 32 and the detection devices 34, is connected to an interface 36 for acquiring data and for controlling the switch devices. The interface acquires the data from the detection devices 34 and controls the switch devices 32 as a function of a predetermined initial route (stored in a memory) between a departure point such as 12 and an arrival point such as 20.

In the invention, the unit 36 is connected to a central processor unit 38 that controls the operation of the interface 36. In particular the central processor unit 38 manages the interface with the control unit 36 by sending intermediate commands and by acquiring data from the switch devices 32 and from the detection devices 34, so as to follow the formation of a changed route, and then its progressive destruction, as a train goes past. Any change made to a route requires the central processor unit 38 to send new commands for controlling the switch devices 32 to the interface 36.

The central processor unit 38 is constituted by a central computer in which all of the programs required to cause changes in routes are loaded.

It is connected to a man/machine interface 40 enabling an operator to enter route change commands, and it has access to a database (not shown) containing all of the possible routes between the departure points 12, 14 and the arrival points 20, 22 of the rail network 10.

More particularly, the central processor unit 38 includes software means making it possible to extract from the database all of the possible routes between a route-change node at which the route changes and a convergence node at which the route converges back on the initial route, so as to compare all of the routes extracted from the database with the initial route for the purpose of retaining only that route which is closest to the initially-planned route, so as to cause a route change along the resulting closest route. The closest route is chosen as being the changed route that has the most way points (points via which the rail vehicle travels) in common with the initially-planned route.

In addition, the central processor unit 38 incorporates software means for computing the journey time along the resulting changed route so as to determine, by extrapolation, the instant at which the rail vehicle will reach the arrival point, and means for using this information to change the time for which the rail vehicle stays at the arrival point, so as to avoid upsetting the rail service timetable.

According to a characteristic of the invention, the journey time computation means compute the journey time of the route section-by-section so as to predict the instant at which the rail vehicle passes through each section.

A change of route can be made at any point of the journey, or, more commonly, at a departure point or at an arrival point, such changes corresponding respectively to a change of departure platform and/or of arrival platform. In addition, an arrival point change can take place while the rail vehicle is already travelling along its route.

In the description below, it is assumed that the route-change node is constituted by the departure point 12 itself, while the initial route convergence node, designated by the general numerical reference 42 in FIG. 1 is constituted by a point of the rail network that is situated downstream from the departure point 12.

Figure 2:
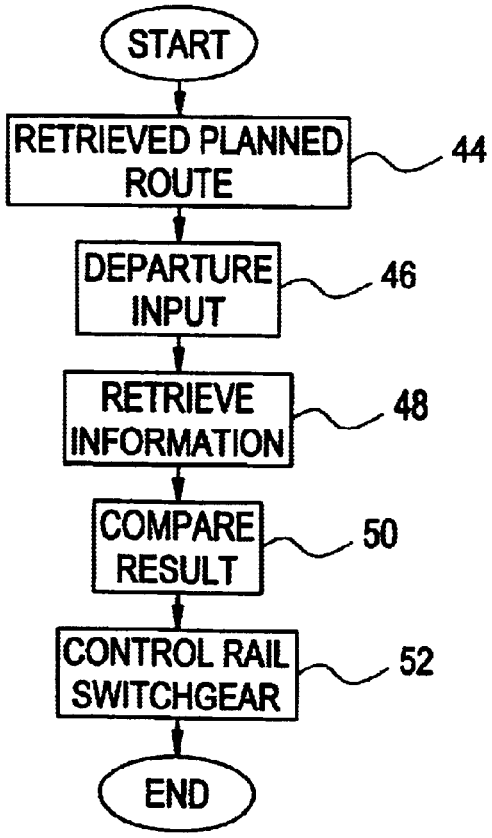
FIG. 2 is a flow chart showing the various stages of operation of the management system of FIG. 1.
Figure 3:
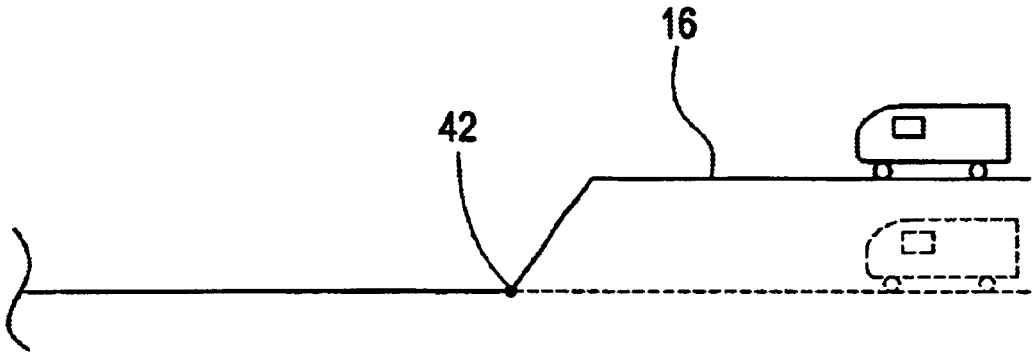
FIG. 3 is a diagrammatic view showing a change of departure platform.

With reference to FIGS. 2 and 3, a description follows of the main operating stages of the above-described route management system.

During a first stage 44, which corresponds to the stage in which an operator decides that the initially-planned route must be changed, the initially-planned route, shown as a dashed line in FIG. 3, is retrieved.

During the next stage 46, the operator enters information relating to the new departure platform 16 by means of the man/machine interface 40.

During the next stage 48, this information is retrieved by the central processor unit 38. The central processor unit compares the changed route with the initially-planned route and extracts from the database all of the possible routes between the departure platform 16 and the convergence node 42 at which the changed route converges back on the initial route.

During the next step 50, the central processor unit 38 compares all of the resulting routes with the initial route and retains only that route which is closest to the initially-planned route. The closest route is chosen to be the changed route that has the most way points (points via which the rail vehicle travels) in common with the initially-planned route.

It then programs the control unit 36 so that said control unit controls the rail switchgear so such that the rail vehicle is caused to travel along the resulting programmed route (step 52).

The central processor unit then uses extrapolation to determine the path of the vehicle and controls the control unit 36 such that the switch devices are actuated at the appropriate instants so that the rail vehicle is switched along the programmed route.

During said step 52, the central processor unit computes the journey time section-by-section for the purpose of controlling the rail switchgear.

Finally, during this step, and on the basis of the computed journey time information, the central processor unit 28 changes the time for which the rail vehicle stays at the arrival point, as a function of the delay due to the route change, so as not to upset the rail service timetable.

Figure 4:
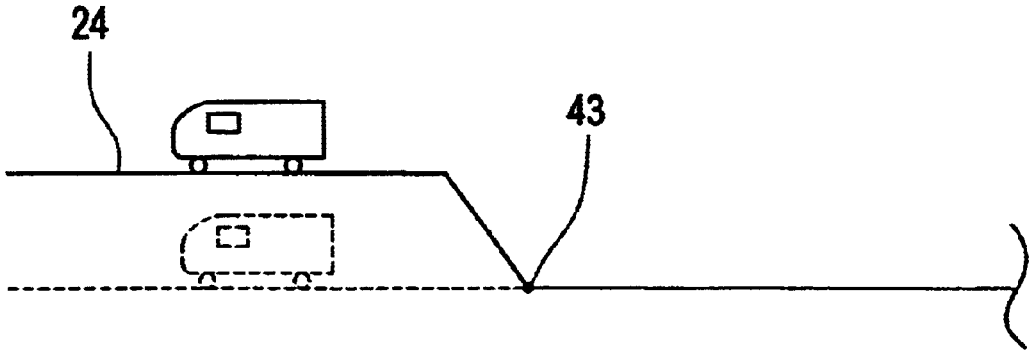
FIG. 4 is a diagrammatic view showing a change of arrival platform.

The above description is of the case when the rail vehicle is constrained to change departure platform. However, as shown in FIG. 4, when the route must be changed because an arrival platform is unavailable, the arrival point of the rail vehicle is then constituted by the arrival platform 24 that lies on the changed route, the route-change node then being constituted by a point 43 of the rail network that is situated upstream from the arrival point, relative to the direction of travel of the rail vehicle along the rail track. In such a case, the changed route travelled by the rail vehicle does not have an initial route convergence node, the convergence node being a virtual point disposed downstream from the arrival point.

The system described herein is particularly useful because it is suitable for changing the route of a rail vehicle while the vehicle is already travelling along said route. This facility makes it easy and quick to cope with any contingencies that might occur on the network, in particular when the platform initially planned to receive a train is unavailable.

What is claimed is:

1. A management system for managing a route of a rail vehicle travelling on a rail network between a departure point and an arrival point, the management system comprising:

detection means for detecting the position of the vehicle on the network, and a central processor unit comprising means for causing a route change in the route of the rail vehicle between a route-change node at which the route changes from an initial route on which the rail vehicle was previously planned to travel, and a convergence node at which the route converges with the initial route, wherein the means for causing the route change includes means for determining a set of routes comprising all possible routes between the route-change node and the convergence node, and means for comparing the set of routes with the initial route so as to cause the route change to correspond to a route among the set of routes that has a largest number of way points in common with the initial route.

2. A management system according to claim 1, wherein the central processor unit further comprises computing means for computing a travel time along the route as changed between the route-change node and the convergence node.

3. A management system according to claim 2, wherein the computing means includes means for computing the travel time along each section of the route as changed between the route-change node and the convergence node.

4. A management system according to claim 2, wherein the central processor unit further comprises means for changing the time for which the rail vehicle stays at the arrival point based on a delay due to the route change.

5. A management system according to claim 1, wherein the central processor unit further comprises means for changing the route or the arrival point of a rail vehicle, while the rail vehicle is travelling along the route.

6. A management system according to claim 1, wherein, when the departure point corresponding to the initial route of the rail vehicle is changed, the route-change node is the departure point of the rail vehicle.

7. A management system according to claim 1, wherein, when the arrival point corresponding to the initial route of the rail vehicle is changed, the convergence node is situated downstream from the arrival point relative to a direction of travel of the rail vehicle, and the route-change node is situated upstream from the arrival point relative to a direction of travel of the rail vehicle.

* * * * *